US010947810B2

(12) United States Patent
Vasques

(10) Patent No.: US 10,947,810 B2
(45) Date of Patent: Mar. 16, 2021

(54) ANNULAR BARRIER SYSTEM

(71) Applicant: WELLTEC OILFIELD SOLUTIONS AG, Zug (CH)

(72) Inventor: Ricardo Reves Vasques, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 65 days.

(21) Appl. No.: 16/531,289

(22) Filed: Aug. 5, 2019

(65) Prior Publication Data

US 2020/0040693 A1 Feb. 6, 2020

(30) Foreign Application Priority Data

Aug. 6, 2018 (EP) ..... 18187613
Sep. 28, 2018 (EP) ..... 18197786

(51) Int. Cl.
*E21B 33/124* (2006.01)
*E21B 33/127* (2006.01)
(Continued)

(52) U.S. Cl.
CPC ..... *E21B 33/1243* (2013.01); *E21B 33/12* (2013.01); *E21B 33/122* (2013.01);
(Continued)

(58) Field of Classification Search
CPC .... E21B 33/12; E21B 33/1243; E21B 33/127; E21B 33/124; E21B 33/122; E21B 33/128; E21B 33/1285; E21B 34/101
See application file for complete search history.

(56) References Cited

U.S. PATENT DOCUMENTS 3,876,000 A * 4/1975 Nutter ..... E21B 49/088 166/106
4,962,815 A * 10/1990 Schultz ..... E21B 23/006 166/387

(Continued)

FOREIGN PATENT DOCUMENTS

EP 3 199 747 8/2017

OTHER PUBLICATIONS

Search Report for EP18197786.9 filed Jan. 17, 2019, 9 pages.

*Primary Examiner* — Yong-Suk (Philip) Ro
(74) *Attorney, Agent, or Firm* — Nixon & Vanderhye P.C.

(57) ABSTRACT

The present invention relates to an annular barrier system for completing a well with a well tubular metal structure, comprising the well tubular metal structure comprising a first annular barrier and a second annular barrier, each annular barrier being introduced and set in the well to abut a wall of the well providing a confined space having a confined pressure between the wall, part of the well tubular metal structure, the first annular barrier and the second annular barrier, so that the first annular barrier isolates the confined space from a first annulus having a first pressure and the second annular barrier isolates the confined space from a second annulus having a second pressure, wherein the annular barrier system comprises a pressure equalising unit having a first position in which the first annulus is in fluid communication with the confined space and a second position in which the second annulus is in fluid communication with the confined space, in the first position the second pressure is higher than the first pressure, and in the second position the first pressure is higher than the second pressure.

13 Claims, 11 Drawing Sheets

Figure 1:
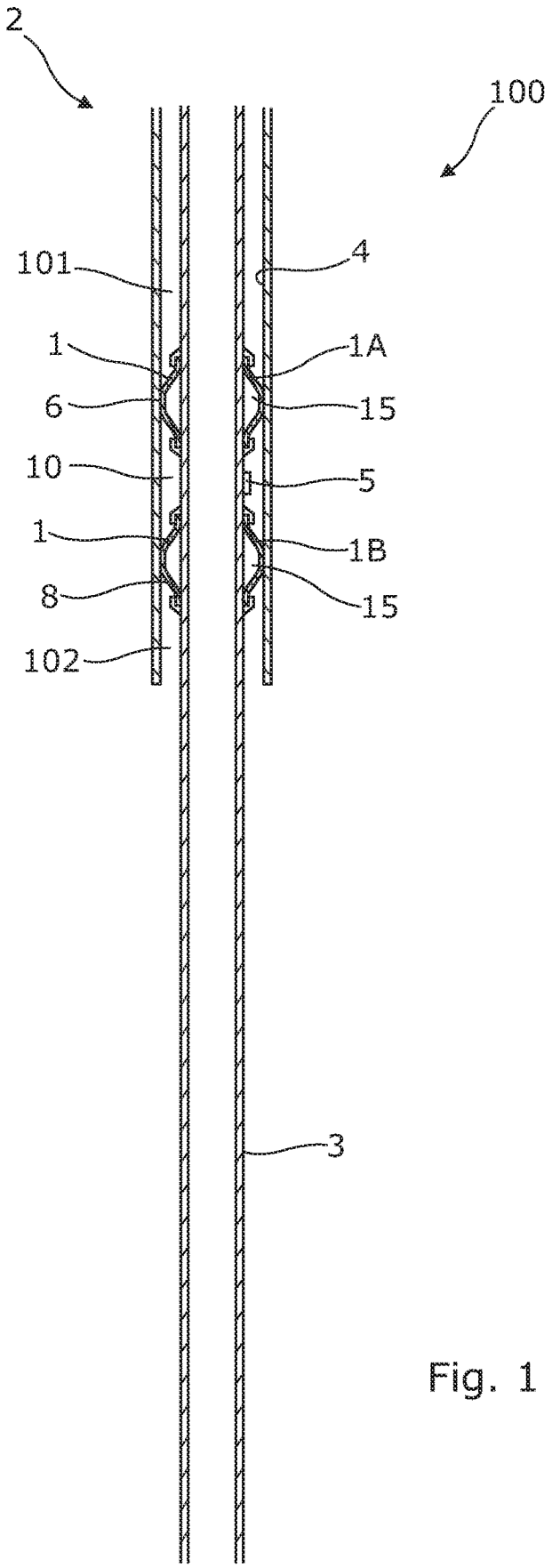

(51) Int. Cl.

| | |
|---|---|
| ***E21B 33/122*** | (2006.01) |
| ***E21B 34/10*** | (2006.01) |
| ***E21B 33/12*** | (2006.01) |
| ***E21B 33/128*** | (2006.01) |

(52) U.S. Cl.
CPC ..... *E21B 33/124* (2013.01); *E21B 33/127* (2013.01); *E21B 33/128* (2013.01); *E21B 33/1285* (2013.01); *E21B 34/101* (2013.01)

(56) References Cited

U.S. PATENT DOCUMENTS

| | | | | |
|---|---|---|---|---|
| 5,287,741 | A * | 2/1994 | Schultz | E21B 49/088 166/250.17 |
| 5,383,520 | A * | 1/1995 | Tucker | E21B 23/006 166/142 |
| 9,708,862 | B2 * | 7/2017 | Hallundbæk | E21B 33/1277 |
| 2002/0178804 | A1 * | 12/2002 | Manke | E21B 49/081 73/152.55 |
| 2014/0216755 | A1 * | 8/2014 | Hallundæk | E21B 33/1243 166/373 |
| 2015/0027724 | A1 * | 1/2015 | Symms | E21B 33/1243 166/373 |
| 2016/0123114 | A1 | 5/2016 | Flores | |
| 2016/0298414 | A1 | 10/2016 | Stæhr et al. | |
| 2017/0051585 | A1 | 2/2017 | Hazel | |

* cited by examiner

ANNULAR BARRIER SYSTEM

This application claims priority to EP Patent Application No. 18187613.7 filed on Aug. 6, 2018 and EP Patent Application No. 18197786.9 filed on Sep. 28, 2018, the entire contents of each of which are hereby incorporated by reference.

The present invention relates to an annular barrier system for completing a well with a well tubular metal structure, comprising the well tubular metal structure comprising a first annular barrier and a second annular barrier, each annular barrier being introduced and set in the well to abut a wall of the well providing a confined space, having a confined pressure between the wall, part of the well tubular metal structure, the first annular barrier and the second annular barrier, so that the first annular barrier isolates the confined space from a first annulus, having a first pressure and the second annular barrier isolates the confined space from a second annulus, having a second pressure.

Annular barrier systems are incorporated into wells for enhancing the performance of the wells and they are applied for multiple functions both in relation to zonal isolation but also for positioning components in the well. As in all other components of the well, the strength and integrity of the annular barrier system are of high importance.

It is desirable to control the strength and the integrity of the annular barriers in relation to its surroundings, especially in relation to measures which influence on the pressure exerted externally on the annular barriers, such as for instance temperature.

It is an object of the present invention to wholly or partly overcome the above disadvantages and drawbacks of the prior art. More specifically, it is an object to provide an improved annular barrier system enhancing the strength and integrity of the annular barriers.

The above objects, together with numerous other objects, advantages and features, which will become evident from the below description, are accomplished by a solution in accordance with the present invention by an annular barrier system for completing a well with a well tubular metal structure, comprising the well tubular metal structure comprising a first annular barrier and a second annular barrier, each annular barrier being introduced and set in the well to abut a wall of the well providing a confined space having a confined pressure between the wall, part of the well tubular metal structure, and the first annular barrier and the second annular barrier, so that the first annular barrier isolates the confined space from a first annulus having a first pressure and the second annular barrier isolates the confined space from a second annulus having a second pressure, wherein the annular barrier system comprises a pressure equalising unit having a first position, in which the first annulus is in fluid communication with the confined space and a second position, in which the second annulus is in fluid communication with the confined space, in the first position the second pressure is higher than the first pressure, and in the second position the first pressure is higher than the second pressure.

The above objects, together with numerous other objects, advantages and features, which will become evident from the below description, are accomplished by a solution in accordance with the present invention by another annular barrier system for completing a well with a well tubular metal structure, comprising the well tubular metal structure comprising a first annular barrier and a second annular barrier, each annular barrier comprises a tubular metal part mounted as part of the well tubular metal structure and an expandable metal sleeve surrounding and being connected with the tubular metal part defining an annular space between the expandable metal sleeve and the tubular metal part, the annular space having a space pressure, and each annular barrier being introduced and set in the well to abut a wall of the well providing a confined space having a confined pressure between the wall, part of the well tubular metal structure, and the first annular barrier and the second annular barrier, so that the first annular barrier isolates the confined space from a first annulus having a first pressure and the second annular barrier isolates the confined space from a second annulus having a second pressure, wherein the annular barrier system comprises a pressure equalising unit having a first position, in which the first annulus is in fluid communication with the confined space and a second position, in which the second annulus is in fluid communication with the confined space, in the first position the second pressure is higher than the first pressure, and in the second position the first pressure is higher than the second pressure.

Furthermore, the pressure equalising unit may have a piston moving between the first position and the second position, and the pressure equalising unit having a first port in fluid communication with the first annulus and a second port in fluid communication with the second annulus and a third port in fluid communication with the confined space.

The pressure equalising unit may have a bore in which the piston slides, the piston dividing the bore into a first chamber and a second chamber, the bore having a bore face, the piston has a first indentation providing a first cavity with the bore face and a second indentation providing a second cavity with the bore face, in the first position the first cavity provides fluid communication between the first port and the third port, and in the second position the second cavity provides fluid communication between the second port and the third port.

Moreover, the piston may comprise a first fluid channel fluidly connecting the first chamber with the second cavity, and second fluid channel fluidly connecting the second chamber with the first cavity.

Also, the ports may be fluidly connected with the confined space, the first annulus and the second annulus via flow lines or control lines.

In addition, each annular barrier may comprise a tubular metal part mounted as part of the well tubular metal structure and an expandable metal sleeve surrounding and connected with the tubular metal part, defining an annular space between the expandable metal sleeve and the tubular metal part, the annular space having a space pressure, in the first unit position the first pressure is higher than the second pressure, and in the second unit position the second pressure is higher than the first pressure.

The annular barrier system may further comprise an anti-collapsing unit, comprising an element movable at least between a first unit position and a second unit position, the anti-collapsing unit having a first inlet which is in fluid communication with the first annulus, and a second inlet which is in fluid communication with the second annulus, and the anti-collapsing unit having an outlet which is in fluid communication with the annular space, and in the first unit position, the first inlet is in fluid communication with the outlet, equalising the first pressure with the space pressure, and in the second unit position, the second inlet is in fluid communication with the outlet, equalising the second pressure with the space pressure.

The outlet may be in fluid communication with the annular space of each annular barrier.

Furthermore, the outlet and the inlets may be fluidly connected with the annular space, the first annulus, and the second annulus via flow lines or control lines.

The annular system may also comprise a shear pin assembly having a first assembly position, in which an expansion opening in the well tubular metal structure is fluidly connected with the annular space and a second assembly position, in which the annular space is fluidly connected with the outlet of the anti-collapsing unit and the fluid communication with the expansion opening is closed.

The expansion opening may be fluidly connected with the annular space of each annular barrier.

Moreover, the pressure equalising unit may be arranged in the confined space.

Also, the shear pin assembly may be arranged in the confined space.

In addition, the anti-collapsing unit may be arranged in the confined space.

The annular barrier system may further comprise one or more intermediate annular barrier(s) arranged in the confined space dividing the confined space into first and second confined spaces, in the first position of the pressure equalising unit, the first annulus being in fluid communication with the first confined space and in the second position, the second annulus being in fluid communication with the first confined space.

Moreover, the annular barrier system may further comprise one or more intermediate annular barrier(s) arranged in the confined space dividing the confined space into first and second confined spaces, in the first position of the pressure equalising unit the first annulus being in fluid communication with the first confined space and the second confined space and in the second position, the second annulus being in fluid communication with the first confined space and the second confined space.

Furthermore, the annular barrier system may further comprising one or more intermediate annular barrier(s) arranged in the confined space dividing the confined space into several confined spaces, the pressure equalising unit being in the first position in which the first annulus is in fluid communication with one of the confined spaces and a second position in which the second annulus is in fluid communication with the one of the confined spaces, in the first position the second pressure is higher than the first pressure, and in the second position the first pressure is higher than the second pressure.

Additionally, the annular barrier system may further comprising one or more intermediate annular barrier(s) arranged in the confined space dividing the confined space into first and second confined spaces, the pressure equalising unit being a first pressure equalising unit which in the first position of the first pressure equalising unit, the first annulus is in fluid communication with the first confined space and in the second position, the second annulus is in fluid communication with the first confined space, the annular barrier system further comprises a second pressure equalising unit which in the first position of the second pressure equalising unit, the first annulus is in fluid communication with the second confined space and in the second position the second annulus is in fluid communication with the second confined space.

The annular barriers may comprise sealing elements arranged on an outer face of the expandable metal sleeves.

Also, the sealing elements may be arranged in grooves on an outer face of the expandable metal sleeves.

Also, a sealing element and a split ring-shaped retaining element may be arranged in a groove, the split ring-shaped retaining element forming a back-up for the sealing element.

Additionally, the split ring-shaped retaining element may have more than one winding, so that when the expandable tubular is expanded from a first outer diameter to a second outer diameter being larger than the first outer diameter, the split ring-shaped retaining element partly unwinds.

Furthermore, an intermediate element may be arranged between the split ring-shaped retaining element and the sealing element.

Also, the expandable metal sleeves may be welded to an outer face of the tubular metal part.

Each annular barrier may further comprise a first connection part connecting a first end of the expandable metal sleeve to an outer face of the tubular metal part and a second connection part connecting a second end of the expandable metal sleeve to the outer face of the tubular metal part.

Furthermore, the invention relates to an annular barrier system having an anti-collapsing unit and a shear pin assembly, as described above, where the outlet of the outlet of the anti-collapsing unit is fluidly connected to the annular space of both the first annular barrier and the second annular barrier.

Hereby, the axial load of the annular barrier system is almost double, meaning that the annular barrier system can be loaded with almost twice the load as when only using one annular barrier without moving axially. This is due to the fact that both the first annular barrier and the second annular barrier are pressurised with the highest pressure of the first and second annuli and when stimulating with a high pressure this high pressure is equalised to the annular space of both the first annular barrier and the second annular barrier.

The invention also relates to a downhole completion comprising an annular barrier system as described above.

The invention furthermore relates to a completion method for completing a well with a well tubular metal structure, comprising providing an annular barrier system as described above,
arranging the well tubular structure in the well,
setting the first annular barrier and the second annular barrier for providing a confined space between them,
equalising the confined pressure with the lowest of either the first pressure or the second pressure.

Figure 2:
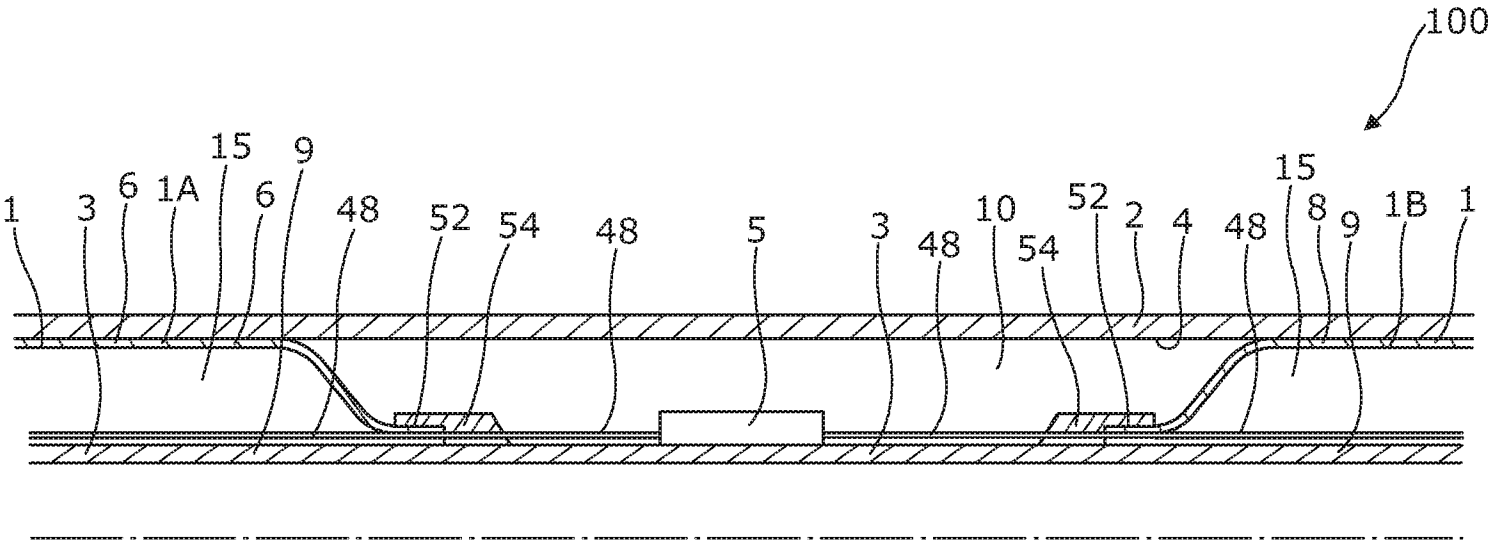
Figure 3A:
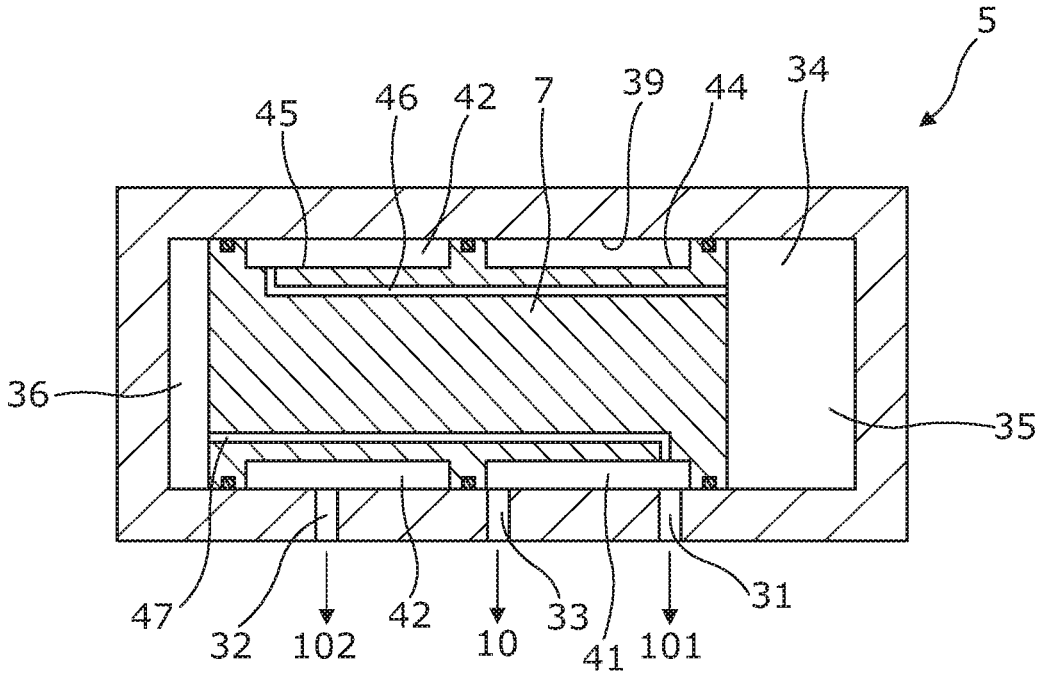
Figure 3B:
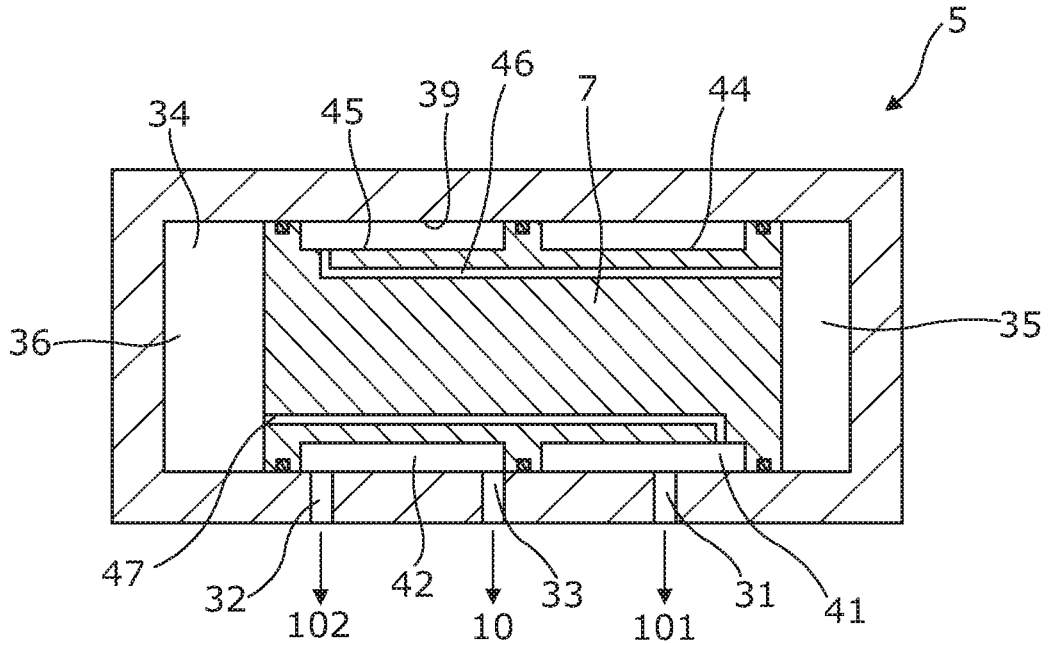
Figure 4:
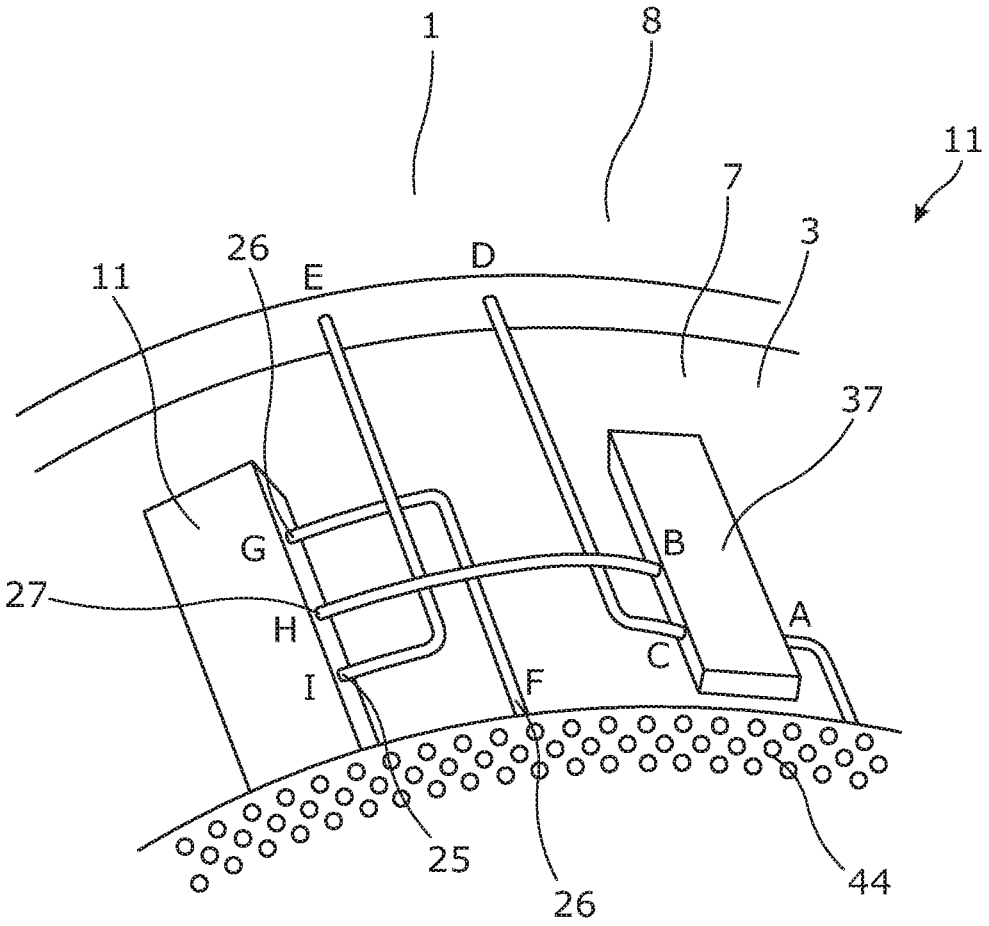
Figure 5A:
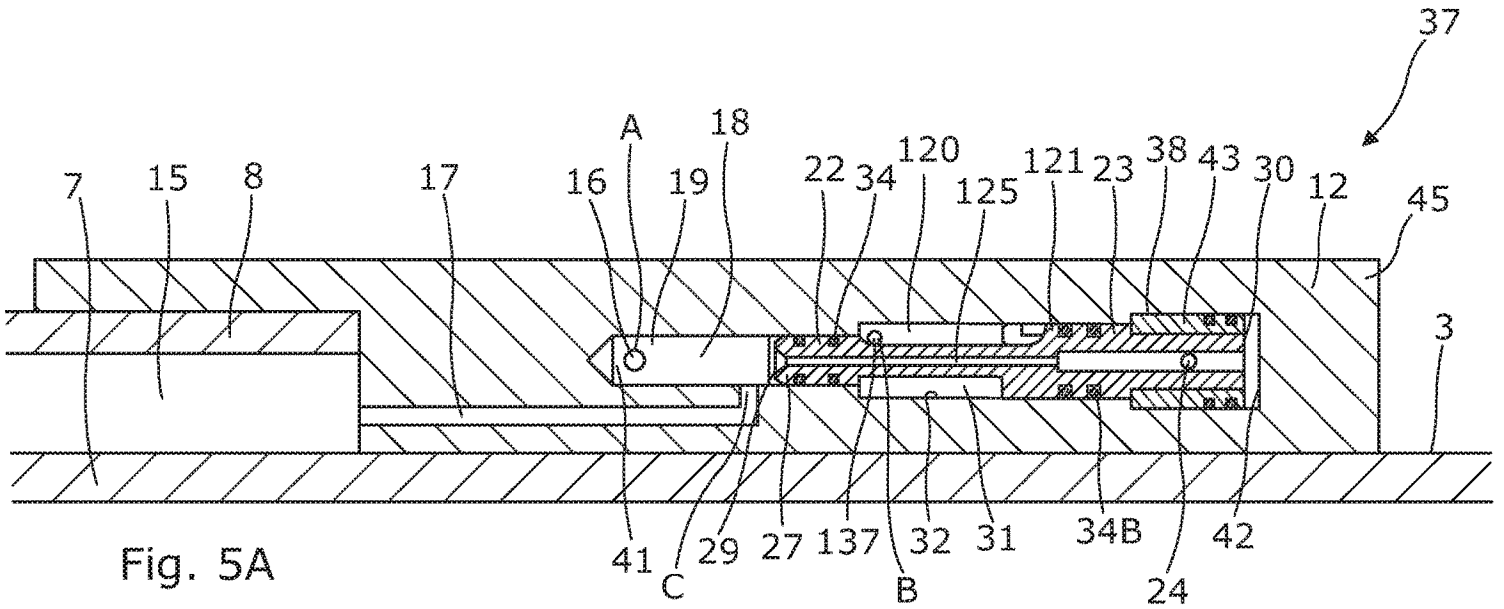
Figure 5B:
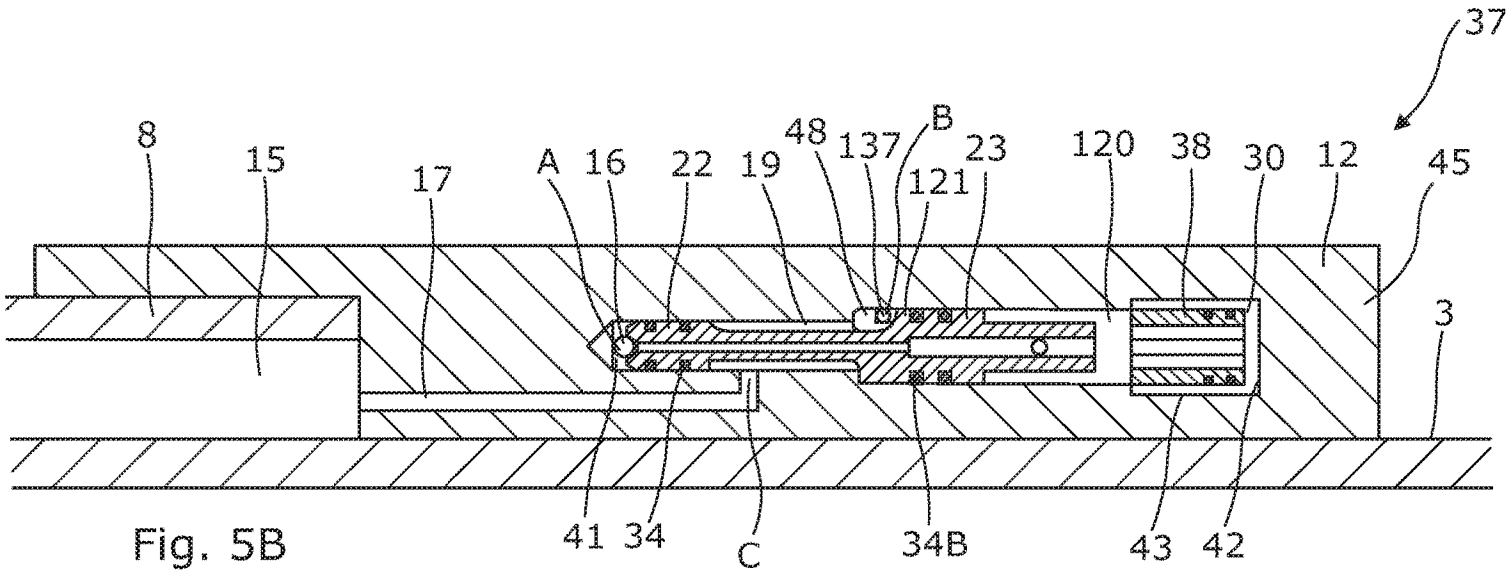
Figure 6:
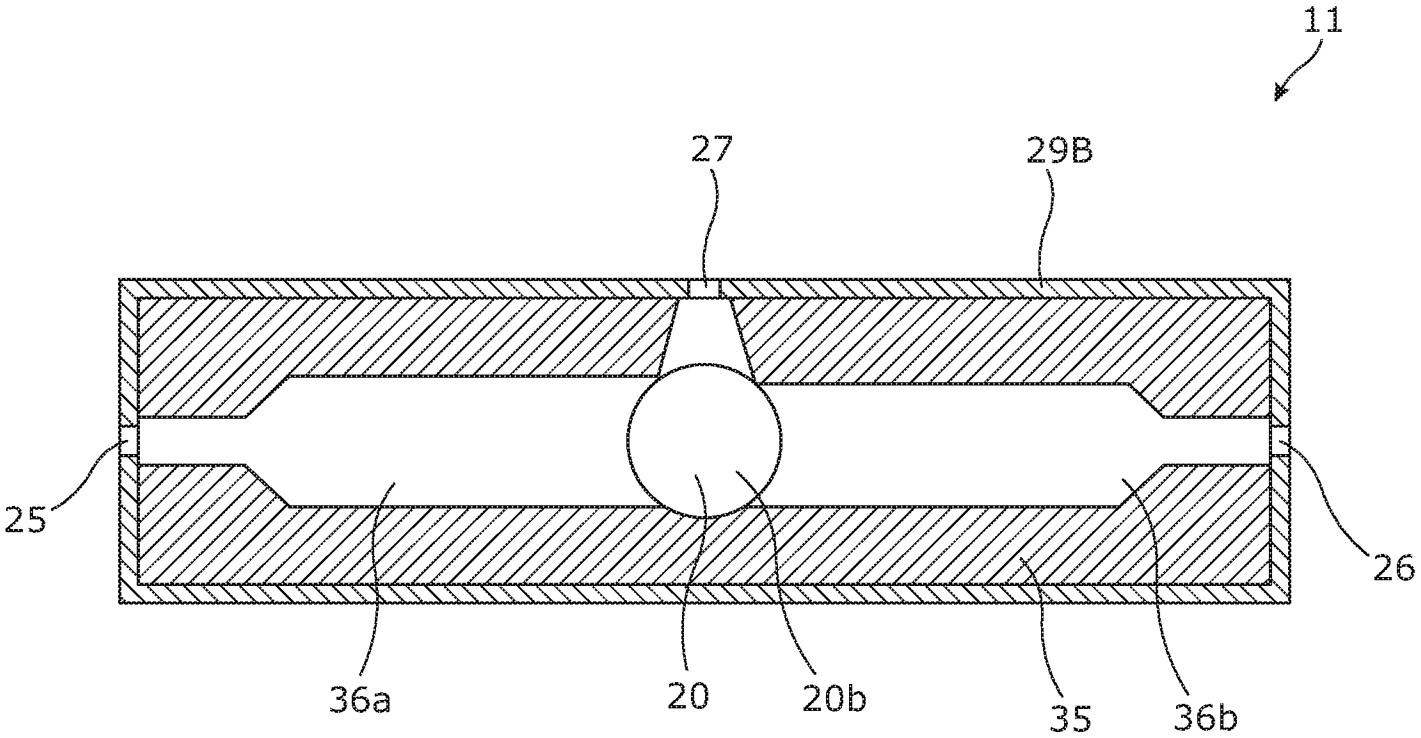
Figure 7:
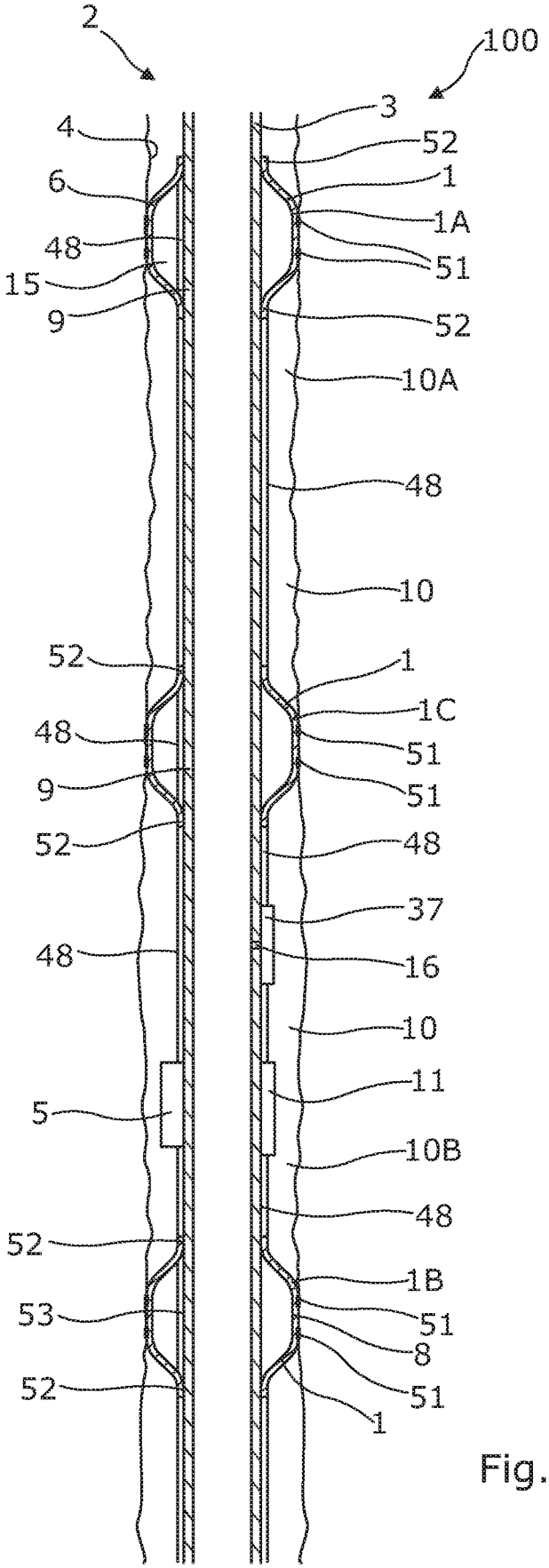
Figure 8:
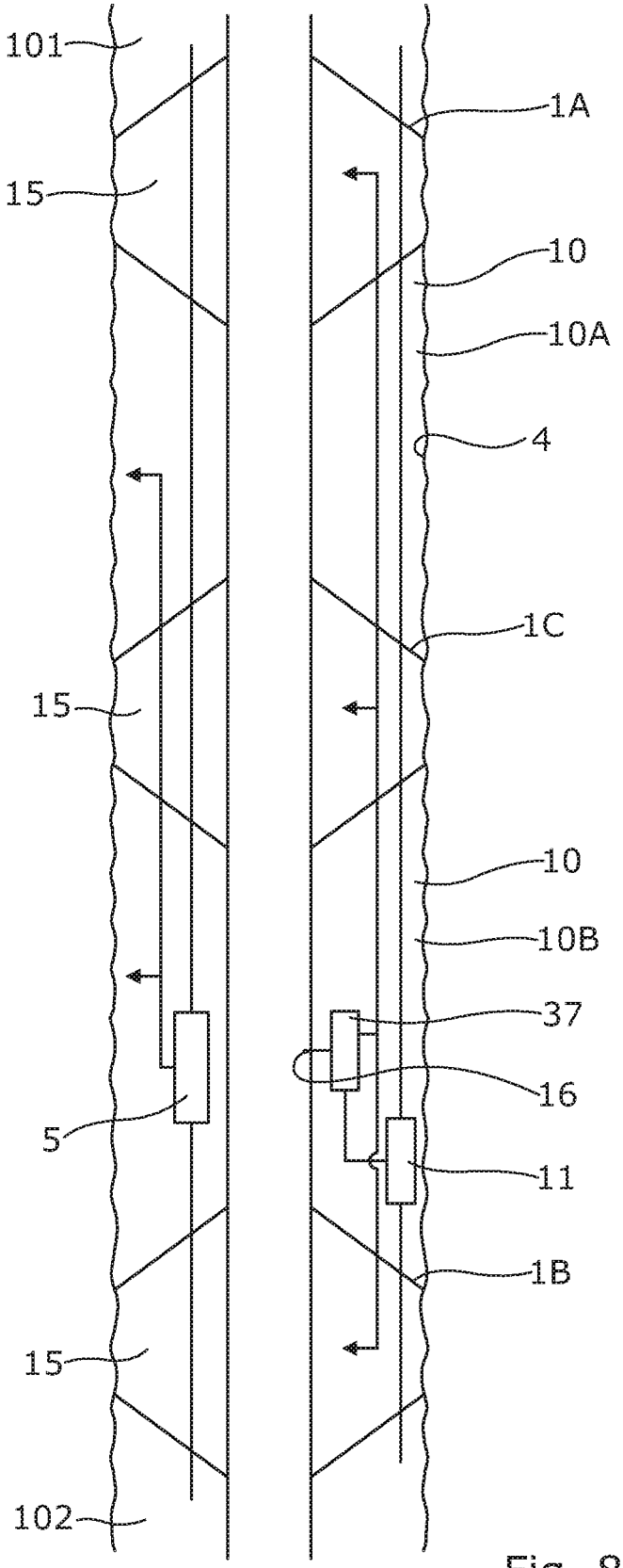
Figure 9:
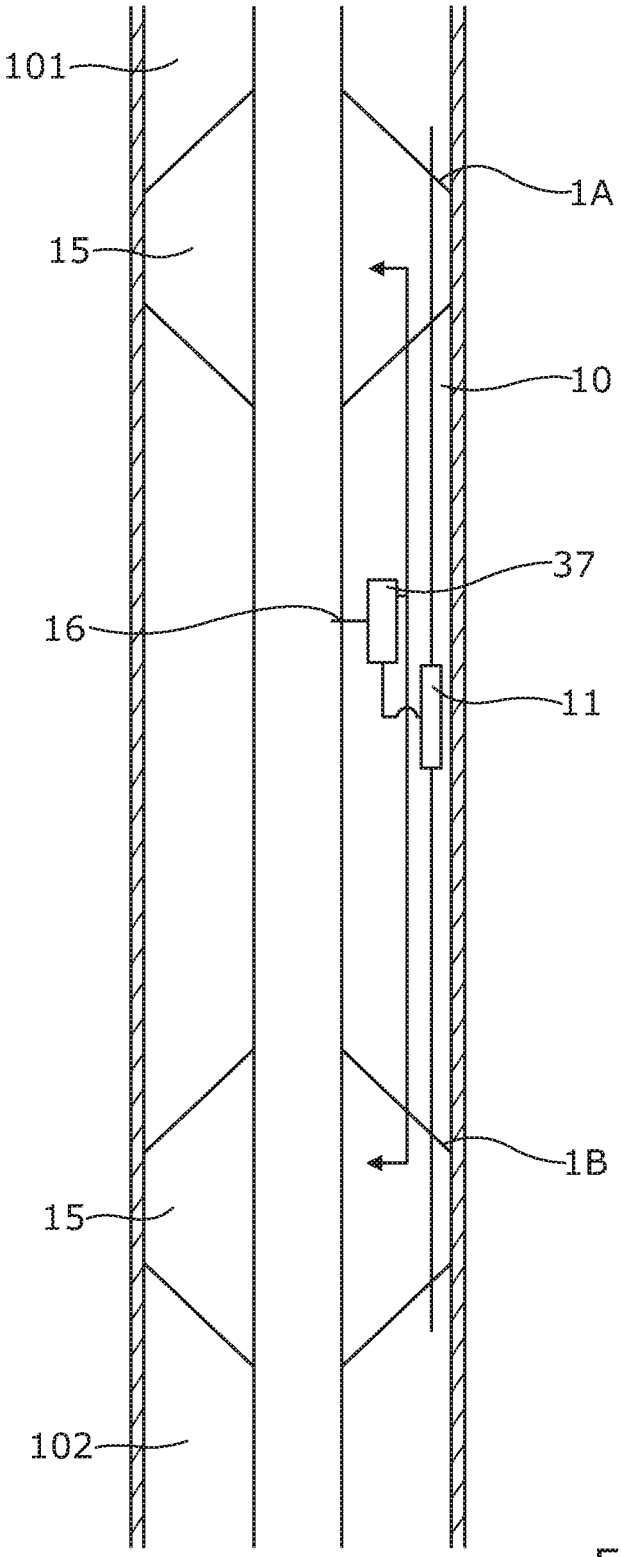
Figure 10:
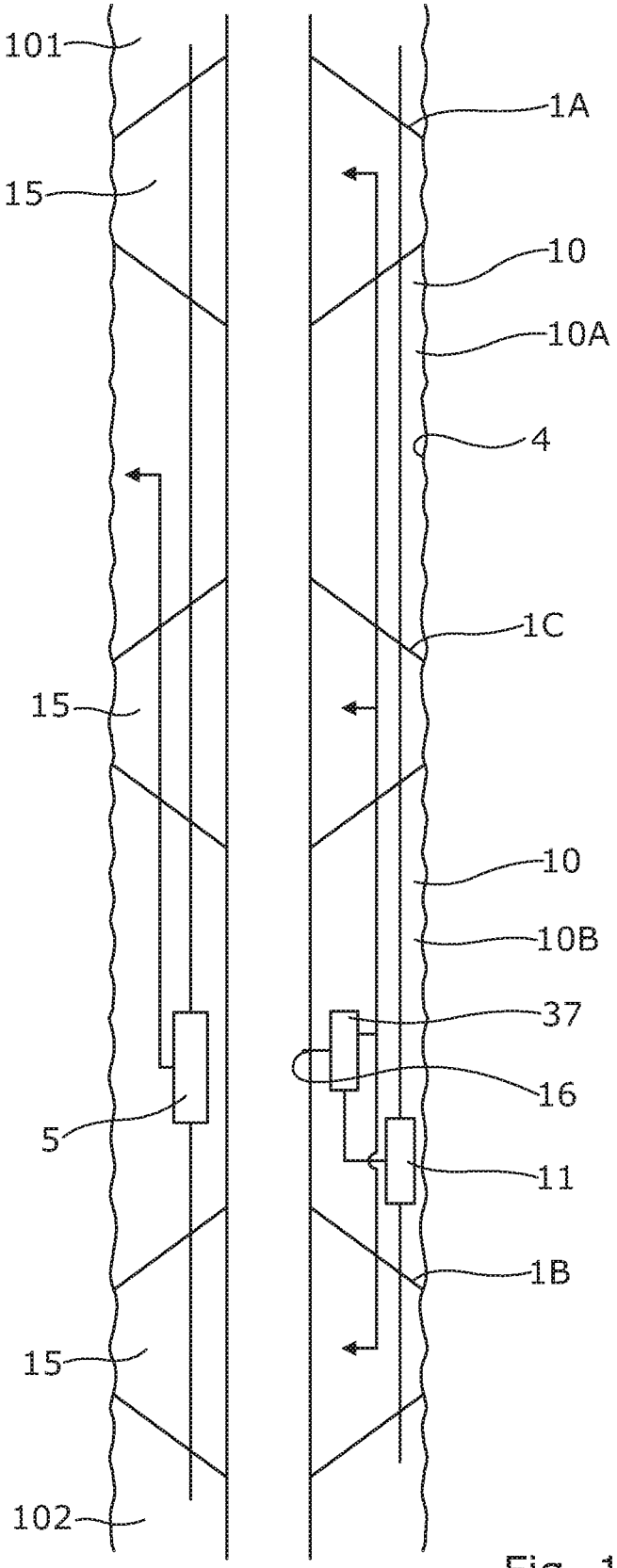
Figure 11:
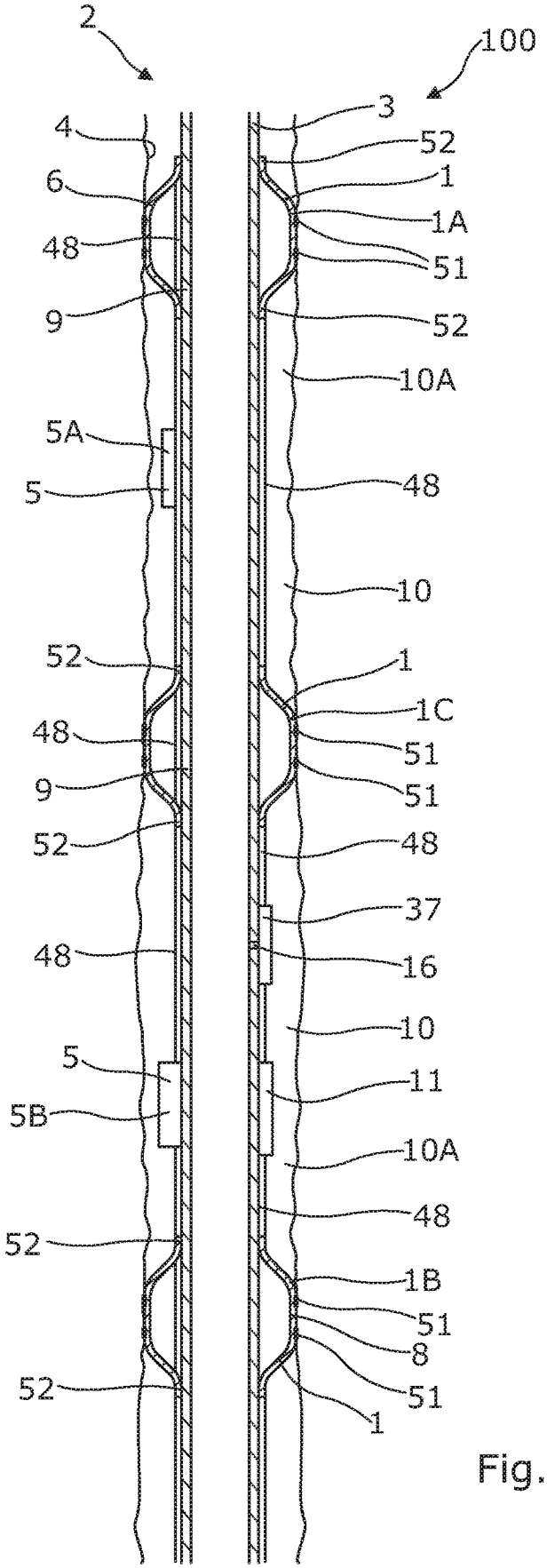

The invention and its many advantages will be described in more detail below with reference to the accompanying schematic drawings, which for the purpose of illustration show some non-limiting embodiments and in which:

FIG. 1 shows a cross-sectional view of an annular barrier system where annular barriers of a well tubular metal structure are set within another well tubular metal structure forming a confined space which is pressure equalised with the lowest pressure of either the first pressure of the first annulus or the second pressure of the second annulus, FIG. 2 shows a partly cross-sectional view of an annular barrier system having a pressure equalising unit, FIG. 3A shows a cross-sectional view of a pressure equalising unit in a first position, FIG. 3B shows the pressure equalising unit of FIG. 3A in a second position, FIG. 4 shows in perspective part of another annular barrier having a shear pin assembly and an anti-collapsing unit, FIGS. 5A and 5B show a cross-sectional view of part of another annular barrier having a shear pin assembly, the shear pin assembly is shown in a first assembly position in FIG. 5A, and in its second closed assembly position in FIG. 5B, FIG. 6 shows a cross-sectional view of an anti-collapse unit, FIG. 7 shows a partly cross-sectional view of an annular barrier system having three annular barriers set in a borehole, FIG. 8 is a schematic sketch of fluid flow in the annular barrier system having three annular barriers, FIG. 9 shows a schematic sketch of fluid flow in another annular barrier system having two annular barriers, FIG. 10 is a schematic sketch of fluid flow in another annular barrier system having three annular barriers, and FIG. 11 shows a partly cross-sectional view of another annular barrier system having three annular barriers set in a borehole and two pressure equalising units.

All the figures are highly schematic and not necessarily to scale, and they show only those parts which are necessary in order to elucidate the invention, other parts being omitted or merely suggested.

FIG. 1 shows an annular barrier system 100 for completing a well 2 with a well tubular metal structure 3, where the well tubular metal structure may be arranged as an inner string within another well tubular metal structure as shown in FIG. 1, may be hung off from another well tubular metal structure, or may be arranged for providing zones in a borehole. The annular barrier system 100 comprises a well tubular metal structure 3 having a first annular barrier 1, 1A and a second annular barrier 1, 1B. The first and second annular barrier thereby form part of the well tubular metal structure so when set, part of the annular barriers are radially expanding or swelling so as to form zonal isolation between the well tubular metal structure and another well tubular metal structure, or between the well tubular metal structure and the wall of the borehole. Each annular barrier is introduced with the well tubular metal structure and set, e.g. by radially expansion or swelling, in the well to abut a wall 4 of the well providing a confined space 10 between the wall 4 and the first annular barrier and the second annular barrier, so that the first annular barrier 1B isolates the confined space 10 from a first annulus 101 having a first pressure, and the second annular barrier 1B isolates the confined space from a second annulus having a second pressure. The annular barrier system further comprises a pressure equalising unit 5 having a first position, in which the first annulus 101 is in fluid communication with the confined space 10, and a second position, in which the second annulus 102 is in fluid communication with the confined space 10. In the first position the second pressure is higher than the first pressure, and in the second position the first pressure is higher than the second pressure—like a reverse shuttle valve. Hereby, the pressure in the confined space 10 is equalised with the lowest pressure of the first annulus or the second annulus. When setting annular barriers in a metal tubular, i.e. another well tubular metal structure, or opposite the cap rock layer, the pressure in the confined space may change with the temperature changes downhole without being able to equalise this pressure with its surroundings, which may jeopardise the integrity of the well but by having a pressure equalising unit 5 equalising the pressure in the confined space with the lowest pressure in the first and second annuli, the pressure in the confined space can always be equalised and the well integrity is thus maintained independently of the surrounding pressures and temperatures.

The annular barriers may be all kinds of annular barriers, such as swellables (swelling packers), metal annular barriers, or mechanical set packers. Most mechanical packers have a rubber or elastomeric element expanding radially by pressing axially from one or both sides of the rubber or elastomeric element.

As can be seen in FIGS. 3A and 3B, the pressure equalising unit 5 has a piston 7 moving between the first position, shown in FIG. 3A, and the second position, shown in FIG. 3B. The pressure equalising unit 5 has a first port 31 in fluid communication with the first annulus 101, a second port 32 in fluid communication with the second annulus 102, and a third port 33 in fluid communication with the confined space 10. The pressure equalising unit 5 has a bore 34 in which the piston 7 slides dividing the bore into a first chamber 35 and a second chamber 36. The bore has a bore face 39, and the piston has a first indentation 44 providing a first cavity 41 with the bore face 39 and a second indentation 45 providing a second cavity 42 with the bore face 39. In the first position, the first cavity 41 provides fluid communication between the first port 31 and the third port 33, and in the second position the second cavity 42 provides fluid communication between the second port 32 and the third port 33. The piston comprises a first fluid channel 46 fluidly connecting the first chamber 35 with the second cavity 42, and second fluid channel 47 fluidly connecting the second chamber 36 with the first cavity 41. The highest pressure of the first or second annuli thereby push the piston, so that if the highest pressure is in the first annulus, the piston is moved to the second position, so that the lower pressure in the second annulus is equalised with the pressure in the confined space. The piston is thus moved between the first and the second position, and in the first position the second port 32 is disconnected from the third port and the confined space, and in the second position the first port 31 is disconnected from the third port and the confined space.

As shown in FIG. 2, the first and second ports are fluidly connected with the first annulus and the second annulus via flow lines 48 or control lines. Each annular barrier 1, 1A, 1B comprises a tubular metal part 9 mounted as part of the well tubular metal structure 3 and an expandable metal sleeve 6, 8 surrounding and being connected with the tubular metal part 9 defining an annular space 15 between the expandable metal sleeve 6, 8 and the tubular metal part 9, the annular space 15 having a space pressure.

In FIG. 4, the annular barrier system 100 further comprises a shear pin assembly 37 fluidly connecting an expansion opening 16 (shown in FIGS. 5A/B and 7-9) of the well tubular metal structure and the annular space 15 (shown in FIG. 7) of one or more annular barriers in order to allow expansion fluid within the well tubular structure 3 to expand the expandable metal sleeves 6, 8. The shear pin assembly 37 has a first assembly position (shown in FIG. 5A), in which expansion fluid is allowed to flow into the annular space 15 and a second assembly position (shown in FIG. 5B), in which the opening 16 is blocked, preventing expansion fluid from entering the annular space 15 and in which second assembly position the annular space is fluidly connected with the outlet of an anti-collapsing unit 11. The expansion opening is fluidly connected with the annular space 15 of each annular barrier 1.

As shown in FIG. 4, the annular barrier system 100 further comprises an anti-collapsing unit 11 comprising an element 20, as shown in FIG. 6, movable at least between a first unit position and a second unit position. The anti-collapsing unit has a first inlet 25, which is in fluid communication with the first annulus 101 (shown in FIG. 8) of the first zone, and a second inlet 26, which is in fluid communication with the second annulus 102 (shown in FIG. 8) of the second zone.

The anti-collapsing unit has an outlet 27, which is in fluid communication with the annular space. In the first unit position, the first inlet is in fluid communication with the outlet, equalising the first annulus pressure of a first zone/annulus 101 with the space pressure in the annular space, and in the second position, the second inlet is in fluid communication with the outlet, equalising the second pressure of the second zone/annulus 102 with the space pressure. The outlet is in fluid communication with the annular space of each annular barrier. The outlet and the inlets are fluidly connected with the annular space; the first annulus and the second annulus via flow lines e.g. tubes.

As shown in FIG. 4, the annular barrier system 100 further comprises the shear pin assembly 37. The shear pin assembly 37 has a port A receiving fluid from an inside of the well tubular metal structure 3. The port A is fluidly connected with a port D during expansion, causing the expansion fluid within the well tubular metal structure to expand the expandable metal sleeves 6, 8. When the expandable sleeves 6, 8 are expanded to abut the wall of the tubular structure or borehole, the pressure builds up and a shear pin or disc within the shear pin assembly shears, closing the fluid connection from port A and opening 16 (as shown in FIG. 5B) and opening the fluid connection between a port B (in fluid communication with the outlet 27) and a port C (in fluid communication with the annular space 15), so that fluid from the second inlet 26 can be let into the annular space 15 through the shear pin assembly 37. When the first annulus pressure increases in the first zone/annulus 101, fluid from a port E connected with a port I, being the first inlet 25, presses the element 20 (shown in FIG. 6) to move so that fluid communication is provided between port I and a port H, being the outlet, and thus further through ports B and C and into the annular space/-s through port D. When the second annulus pressure increases in the second zone/annulus 102, the element is forced in the opposite direction, and fluid communication between port G (in fluid communication with the second zone through port F) and port H is provided, i.e. fluid communication between the second inlet 26 and the outlet 27 of the anti-collapsing unit 11, and thus, fluid is let into the annular space/-s through ports B, C and D.

The shear pin assembly shown in FIGS. 5A and 5B comprises a first bore part 19 having a first inner diameter and a second bore part 120 having an inner diameter, which is larger than that of the first bore part. The opening 17 and a second opening 17 are arranged in the first bore part 19 and are displaced along the bore extension. The shear pin assembly further comprises an assembly piston 121 arranged in the bore 18, the piston comprising a first piston part 22 having an outer diameter substantially corresponding to the inner diameter of the first bore part 19 and comprising a second piston part 23 having an outer diameter substantially corresponding to the inner diameter of the second bore part 120. The shear pin assembly further comprises a rupture element 24 preventing movement of the assembly piston 121 until a predetermined pressure in the bore 18 is reached. The strength of the rupture element is set based on a predetermined pressure acting on the areas of the ends of the assembly piston, and thus, the difference in outer diameters results in a movement of the assembly piston, when the pressure exceeds the predetermined pressure. The assembly piston 121 comprises a fluid channel 125 being a through bore providing fluid communication between the first and second bore parts 19, 120.

In FIGS. 5A and 5B, the rupture element 24 is a shear pin, but it may also be a disc. In FIG. 5A, the shear pin is intact and extends through the piston and the inserts 43, and in FIG. 5B, the shear pin is sheared, the piston is allowed to move, and the inserts 43 have moved towards the centre of the bore 18. Depending on the isolation solution required to provide isolation downhole, the rupture element 24 is selected based on the expansion pressure so as to break at a pressure higher than the expansion pressure but lower than the pressure which ruptures the expandable metal sleeve or jeopardises the function of other completion components downhole. The bore 18 and the assembly piston 121 may be arranged in a connection part 12, connecting the first ends to the tubular metal part.

In FIG. 5A, the shear pin assembly comprises a locking element 38 which is arranged around the second piston part 23. The bore further comprises a third opening 137 in the second bore part 120, which third opening is in fluid communication with the annular space 15 and the annulus/borehole 2. The third opening 137 may be arranged in fluid communication with an anti-collapsing unit 11, as shown in FIG. 6, in such a way that the anti-collapsing unit is arranged between the third opening and the first annulus and second annulus, thus providing fluid communication between the annular space and the first annulus and second annulus. The anti-collapsing unit being a shuttle valve provides, in a first position, fluid communication between the annular space and the first zone/annulus 101, and in a second position, the shuttle valve provides fluid communication between the annular space and the second zone/annulus 102.

As can be seen in FIG. 1, the pressure equalising unit is arranged in the confined space. And in FIG. 7, the shear pin assembly and the anti-collapsing unit are also arranged in the confined space. In FIG. 7, the annular barrier system 100 further comprises an intermediate annular barrier 1C arranged in the confined space 10 dividing the confined space into a first confined space 10A and a second confined space 10B. In another embodiment, the annular barrier system comprises several intermediate annular barriers dividing the confined space into several confined spaces accordingly.

In FIG. 7, the annular barriers 1, 1A, 1B, 1C comprise sealing elements 51 arranged on an outer face of the expandable metal sleeves 6, 8. First and second ends 52 of the expandable metal sleeve 6, 8 are welded to an outer face 53 of the tubular metal part 9. In FIG. 2, the first and second ends 52 of the expandable metal sleeves 6, 8 are connected to the tubular metal part 9 by means of connection parts 12, 54.

FIG. 8 shows a schematic drawing to illustrate the fluid flow of the annular barrier system having a pressure equalising unit 5, an anti-collapsing unit 11 and a shear pin assembly 37. As can be seen to the right in FIG. 8, the expansion opening 16 delivers fluid from within the well tubular metal structure to the shear pin assembly 37, which in a first assembly position delivers the fluid to all three annular barriers past the anti-collapsing unit 11 and in a second assembly position disconnects the expansion opening and fluidly connects the anti-collapsing unit 11 with the flow line to the annular spaces 15 of the annular barriers. The inlets of the anti-collapsing unit 11 are connected to the first annulus and the second annulus as described above. The pressure equalising unit 5, shown to the left side, has a third port fluidly connected with both the first confined space 10A and the second confined space 10B and the first port being fluidly connected to the first annulus 101 and the second port being fluidly connected to the second annulus 102. Thus, the pressure equalising unit can be connected to the several confined spaces for equalising the pressure therein with the lowest of either the first annulus pressure or the second annulus pressure. The shear pin assembly 37 may also be connected for pressurising the annular space of three or more annular barriers. Thus, the annular barrier system may have more than three annular barriers and still function as illustrated in FIG. 8 where the pressure equalising unit is fluidly connected to all confined spaces isolated by the more than three annular barriers.

FIG. 10 shows a schematic drawing to illustrate the fluid flow of the annular barrier system having a pressure equalising unit 5, an anti-collapsing unit 11 and a shear pin assembly 37. As can be seen to the right in FIG. 10, the expansion opening 16 delivers fluid from within the well tubular metal structure to the shear pin assembly 37, which in a first assembly position delivers the fluid to all three annular barriers past the anti-collapsing unit 11 and in a second assembly position disconnects the expansion opening and fluidly connects the anti-collapsing unit 11 with the flow line to the annular spaces 15 of the annular barriers. The inlets of the anti-collapsing unit 11 are connected to the first annulus and the second annulus as described above. The pressure equalising unit 5, shown to the left side, has a third port fluidly connected with only one of the confined spaces i.e. here the first confined space 10A and the first port being fluidly connected to the first annulus 101 and the second port being fluidly connected to the second annulus 102. The annular barrier system may therefore only be equalising the pressure from either of the first and second annulus to one of the confined spaces, e.g. the confined space most exposed to high pressure changes, in order to simplify the system.

In FIG. 11, the annular barrier system has two pressure equalising units 5, i.e. a first pressure equalising unit (5, 5A) and a second pressure equalising unit (5B). In the first position of the first pressure equalising unit (5, 5A), the first annulus is in fluid communication with the first confined space and in the second position the second annulus is in fluid communication with the first confined space. In the first position of the second pressure equalising unit (5), the first annulus is in fluid communication with the second confined space, and in the second position, the second annulus is in fluid communication with the second confined space.

FIG. 9 shows a schematic drawing which illustrates the fluid flow of the annular barrier system having only an anti-collapsing unit 11 and a shear pin assembly 37. The outlet of the anti-collapsing unit 11 is fluidly connected to the annular space 15 of both the first annular barrier 1A and the second annular barrier 1B. Hereby, the axial load of the annular barrier system is almost double, meaning that the annular barrier system can be loaded with almost twice the load as when only using one annular barrier without moving axially. This is due to the fact that both the first annular barrier 1A and the second annular barrier 1B are pressurised with the highest pressure of the first and second annuli and that when stimulating with a high pressure this high pressure is equalised to the annular space of both first annular barrier 1A and the second annular barrier 1B.

Although the invention has been described in the above in connection with preferred embodiments of the invention, it will be evident for a person skilled in the art that several modifications are conceivable without departing from the invention as defined by the following claims.

The invention claimed is:

1. An annular barrier system for completing a well with a well tubular metal structure, comprising the well tubular metal structure comprising a first annular barrier and a second annular barrier, each annular barrier being introduced and set in the well to abut a wall of the well providing a confined space having a confined pressure between the wall, part of the well tubular metal structure, the first annular barrier and the second annular barrier, so that the first annular barrier isolates the confined space from a first annulus having a first pressure and the second annular barrier isolates the confined space from a second annulus having a second pressure, wherein the annular barrier system comprises a pressure equalising unit having a first position in which the first annulus is in fluid communication with the confined space and a second position in which the second annulus is in fluid communication with the confined space, in the first position the second pressure is higher than the first pressure, and in the second position the first pressure is higher than the second pressure.

2. The annular barrier system according to claim 1, wherein the pressure equalising unit has a piston moving between the first position and the second position, and the pressure equalising unit has a first port in fluid communication with the first annulus, a second port in fluid communication with the second annulus, and a third port in fluid communication with the confined space.

3. The annular barrier system according to claim 2, wherein the pressure equalising unit has a bore in which the piston slides, the piston dividing the bore into a first chamber and a second chamber, the bore having a bore face, the piston having a first indentation providing a first cavity with the bore face, and a second indentation providing a second cavity with the bore face, in the first position the first cavity provides fluid communication between the first port and the third port, and in the second position the second cavity provides fluid communication between the second port and the third port.

4. The annular barrier system according to claim 3, wherein the piston comprises a first fluid channel fluidly connecting the first chamber with the second cavity, and second fluid channel fluidly connecting the second chamber with the first cavity.

5. The annular barrier system according to claim 1, wherein each annular barrier comprises a tubular metal part mounted as part of the well tubular metal structure and an expandable metal sleeve surrounding and being connected with the tubular metal part defining an annular space between the expandable metals sleeve and the tubular metal part, the annular space having a space pressure.

6. The annular barrier system according to claim 5, further comprising an anti-collapsing unit comprising an element movable at least between a first unit position and a second unit position, the anti-collapsing unit having a first inlet which is in fluid communication with the first annulus, and a second inlet which is in fluid communication with the second annulus, and the anti-collapsing unit having an outlet which is in fluid communication with the annular space, and in the first unit position, the first inlet being in fluid communication with the outlet, equalising the first pressure with the space pressure, and in the second unit position, the second inlet being in fluid communication with the outlet, equalising the second pressure with the space pressure, in the first unit position the first pressure is higher than the second pressure, and in the second unit position the second pressure is higher than the first pressure.

7. The annular barrier system according to claim 6, further comprising a shear pin assembly having a first assembly position in which an expansion opening in the well tubular metal structure is fluidly connected with the annular space and a second assembly position in which the annular space is fluidly connected with the outlet of the anti-collapsing unit and the fluid communication with the expansion opening closed.

8. The annular barrier system according to claim 1, further comprising one or more intermediate annular barrier(s) arranged in the confined space dividing the confined space into first and second confined spaces, in the first position of the pressure equalising unit, the first annulus is in fluid communication with the first confined space and in the second position, the second annulus is in fluid communication with the first confined space.

9. The annular barrier system according to claim 1, further comprising one or more intermediate annular barrier(s) arranged in the confined space dividing the confined space into first and second confined spaces, in the first position of the pressure equalising unit the first annulus is in fluid communication with the first confined space and the second confined space and in the second position the second annulus is in fluid communication with the first confined space and the second confined space.

10. The annular barrier system according to claim 1, further comprising one or more intermediate annular barrier(s) arranged in the confined space dividing the confined space into several confined spaces, the pressure equalising unit being in the first position in which the first annulus is in fluid communication with one of the confined spaces and a second position in which the second annulus is in fluid communication with the one of the confined spaces, in the first position the second pressure is higher than the first pressure, and in the second position the first pressure is higher than the second pressure.

11. The annular barrier system according to claim 1, further comprising one or more intermediate annular barrier(s) arranged in the confined space dividing the confined space into first and second confined spaces, the pressure equalising unit being a first pressure equalising unit which in the first position of the first pressure equalising unit, the first annulus is in fluid communication with the first confined space and in the second position, the second annulus is in fluid communication with the first confined space, the annular barrier system further comprises a second pressure equalising unit which in the first position of the second pressure equalising unit, the first annulus is in fluid communication with the second confined space and in the second position the second annulus is in fluid communication with the second confined space.

12. A downhole completion comprising an annular barrier system according to claim 1.

13. A completion method for completing a well with a well tubular metal structure, comprising providing an annular barrier system according to claim 1, arranging the well tubular structure in the well, setting the first annular barrier and the second annular barrier for providing a confined space between them, equalising the confined pressure with the lowest of either the first pressure or the second pressure.

* * * * *